US005875869A

United States Patent [19]

Busuttil et al.

[11] Patent Number: 5,875,869

[45] Date of Patent: Mar. 2, 1999

[54] PERSONNEL LIFT WITH AUTOMATIC SET-UP TRANSPORT WHEEL

[75] Inventors: John Busuttil; Bradley K. Allen, both of Redmond; Tracy L. Keller, Botthell, all of Wash.

[73] Assignee: Genie Industries, Inc., Redmond, Wash.

[21] Appl. No.: 730,410

[22] Filed: Oct. 15, 1996

[51] Int. Cl.[6] ..... E06C 1/00

[52] U.S. Cl. ..... 182/69.6; 182/16; 182/63.1; 182/148; 280/43.23

[58] Field of Search ..... 182/16, 19, 63.1, 182/141, 148, 69.4, 69.6; 180/15; 280/43.23, 47

[56] References Cited

U.S. PATENT DOCUMENTS

| | | | |
|---|---|---|---|
| 668,681 | 2/1901 | French . | |
| 1,051,247 | 1/1913 | McLendon . | |
| 1,130,080 | 3/1915 | Germond, Jr. . | |
| 3,074,500 | 1/1963 | Ulinski | 280/43.23 X |
| 3,495,850 | 2/1970 | Ziskal . | |
| 4,053,025 | 10/1977 | Slusarenko | 182/16 X |
| 4,064,999 | 12/1977 | Young | 182/141 X |
| 4,258,825 | 3/1981 | Collins | 182/148 X |
| 4,460,064 | 7/1984 | Lutz et al. | 280/43.23 X |
| 4,531,882 | 7/1985 | Pierre . | |
| 4,592,447 | 6/1986 | Ream et al. | 182/141 X |
| 4,615,533 | 10/1986 | Sewell | 280/43.23 X |
| 4,776,415 | 10/1988 | Brice | 280/43.23 X |
| 4,987,976 | 1/1991 | Daugherty | 182/148 X |
| 4,995,628 | 2/1991 | Orpwood et al. . | |
| 5,035,445 | 7/1991 | Poulin . | |
| 5,105,913 | 4/1992 | Neubauer et al. | 182/148 X |
| 5,116,264 | 5/1992 | Wiederrich et al. . | |
| 5,337,858 | 8/1994 | Neubauer et al. . | |
| 5,535,465 | 7/1996 | Hannat | 280/43.23 X |

*Primary Examiner*—Daniel P. Stodola
*Assistant Examiner*—Richard M. Smith
*Attorney, Agent, or Firm*—Christensen O'Connor Johnson & Kindness PLLC

[57] ABSTRACT

A personnel lift (20) including a three-wheeled transport in which a rear or transport wheel (30) is connected to a lever arm or handle (32) that is designed to raise and lower the transport wheel (30). Pulling the handle (32) downward drops the transport wheel (30) to ground level raising the support legs (34) off the ground. Raising the handle (32) lifts the transport wheel (30) off the ground, dropping the support legs (34) onto the ground. An electric interlock system is utilized to prevent the vertical lift assembly (24) of the personnel lift (20) from being used when the support legs (34) are not on the ground. The electric interlock system includes three switches (89, 104*a*, 104*b*), all of which must be closed in order for the aerial work platform (22) to be elevated. Two of the switches (104*a*, 104*b*) are operated by the support legs (34). The switches (104*a*, 104*b*) in the support legs (34) are closed when the support legs are in full contact with the ground. The third switch (89) is closed when the handle (32) is in a raised position. A mechanical handle locking mechanism (62) prevents a user from lowering the transport wheel (30) and moving the personnel lift (20) when the aerial work platform (22) is elevated. Once the locking mechanism (62) is engaged, the handle (32) cannot be lowered far enough to make the transport wheel (30) engage the ground and raise the support legs (34) from their stabilizing position.

13 Claims, 5 Drawing Sheets

PERSONNEL LIFT WITH AUTOMATIC SET-UP TRANSPORT WHEEL

FIELD OF THE INVENTION

This invention is directed to personnel lifts, and more specifically, personnel lifts that are manually transportable between locations.

BACKGROUND OF THE INVENTION

Personnel lifts are presently used for a wide variety of applications. Personnel lifts generally include an aerial work platform that can be raised or lowered to position a worker at a desired height. Personnel lifts can be used within a plant to raise a worker to a position where the worker can change light bulbs, work on fixtures, or paint overhead surfaces, for example.

In one personnel lift design, the aerial work platform is attached to the upper end of a vertical lift assembly and includes a personnel cage for containing a worker. The vertical lift assembly includes a tower of extendible, nested columns mounted on a base supported by wheels. The tower and base are small so that a worker can easily roll the base to a desired location. Once the personnel lift is placed in the desired location, a number of outriggers are set to stabilize the base. Alternatively, the personnel lift may utilize corner jacks and legs such as are disclosed in U.S. Pat. No. 5,337,858 (the '858 patent). After the personnel lift has been adequately stabilized, a worker enters the personnel cage and operates controls to raise the aerial work platform.

A worker performing tasks in several overhead locations may find it necessary to move a personnel lift a number of times during the day. In general, once the aerial work platform is lifted to the desired height, the worker is limited to doing work in an area that is within arm's length of the aerial work platform. If the worker desires to do work beyond that reach, he or she must lower the aerial work platform, exit the personnel cage, release the outriggers from their secured position, and move the personnel lift to the next desired location. The outriggers must once again be set before the worker can return to the personnel cage and raise the aerial work platform to the desired height.

The personnel lift set forth in the '858 Patent is particularly advantageous in that a worker may rely on corner jacks and legs to stabilize the base of the personnel lift without having to manipulate retractable or removable outriggers. The foot pads and corner jacks are retracted so that the base is supported on caster wheels and may be pushed to a desirable location. However, the device set forth in that patent is not easy to manipulate around a room because no mechanism for steering the caster wheels or easily leading the base to a desired location is included.

There is a need in the art for a more efficient personnel lift that is easily moved to a variety of locations and quickly and easily stabilized.

SUMMARY OF THE INVENTION

In accordance with the present invention, a personnel lift having an automatic set-up transport wheel is provided. Briefly described, the base of the personnel lift includes a three-wheeled transport in which a rear (transport) wheel is connected to a handle operated mechanism that is designed to raise and lower the rear wheel of the transport. Pulling a handle downward drops the rear wheel to ground level and causes support legs to be lifted off the ground. Raising the handle lifts the rear wheel off the ground, allowing the support legs to engage the ground.

An electric interlock system is utilized to prevent the lift mechanism of the personnel lift from being used when the support legs do not engage the ground. The electric interlock system includes three switches, all of which must be engaged for the platform to be elevated. Two of the switches are operated by individual support legs located on opposite sides of the transport wheel. The switches are in one state (e.g., closed) when in full contact with the ground and in the opposite state (i.e., open) when the support legs are not in contact with the ground. The third switch is operated by the handle. When the handle is in a raised position the third switch is in one state (e.g., closed). When the handle is lowered, the third switch is in the opposite state (i.e., open).

A mechanical handle lock system is included which prevents a user from lowering the transport wheel and moving the machine when the platform is elevated. Once the locking mechanism is engaged, the handle cannot be lowered far enough to allow the transport wheel to engage the ground and raise the support legs above their stabilizing position.

More particularly described, the present invention provides a personnel lift having a base, a vertical lift assembly mounted on the base, and a work platform attached to the vertical lift assembly for receiving a worker. The vertical lift assembly is operative to lift the work platform. A vertically movable transport wheel is axially guided the base; and a support leg structure is mounted below the base. A handle is operatively connected to the transport wheel and the base such that movement of the handle up and down causes corresponding movement up and down of the transport wheel. The handle is movable between a first position in which the weight of the rear end of the base is on the transport wheel and the support leg structure is above the ground, and a second position in which the transport wheel is above the ground and the weight of the rear end of the base is on the support leg structure. A locking mechanism is operatively connected between the vertical lift assembly and the handle for preventing movement of the handle to the first position when the vertical lift assembly is in a raised position.

The personnel lift may include a rod extending from the transport wheel and operative to move up and down with the transport wheel in response to the movement of the handle between the first position and the second position. If the rod is used, the locking mechanism is preferably operatively connected to the rod when the aerial work platform is in a raised position such that the locking mechanism prevents movement of the rod up and down and thereby prevents movement of the handle to the first position.

The rod may include a portion of narrowed diameter and a portion of increased diameter axially displaced from the portion of narrowed diameter. In this embodiment of the invention, the locking mechanism includes a piece having a groove that is operable to engage the portion of narrowed diameter of the rod responsive to movement of the work platform upward. The groove has a width that is sufficient to receive the portion of narrowed diameter, but through which the portion of increased diameter cannot pass. Thus, the engagement of the groove with the portion of narrowed diameter prevents movement of the rod downward by the portion of increased diameter engaging the outer perimeter of the groove.

Preferably, the vertical lift assembly includes a vertical tower of extended columns. The locking mechanism is connected to the vertical tower of extended columns. The vertical tower of extended columns includes a first column which initiates movement of the work platform upward, and the locking mechanism is preferably operatively connected to the first column. The locking mechanism prevents movement of the handle to the first position when the first column has been raised only a few inches.

The present invention also provides a personnel lift having a base, a vertical lift assembly mounted on the base, and a work platform attached to the vertical lift assembly for receiving a worker. The vertical lift assembly operatively lifts the work platform. A vertically movable transport wheel is axially guided by the base; and a support leg structure is mounted below the base. A handle is operatively connected to the transport wheel and the base such that movement of the handle up and down causes a corresponding movement up and down of the transport wheel. The handle is movable between a first position in which the weight of the rear end of the base is on the transport wheel and the support leg structure is above the ground, and a second position in which the transport wheel is above the ground and the weight of the rear end of the base is on the support leg structure. A switch is closed when the handle is in the second position. An electronic interlock system prevents the work platform from being raised unless the switch is closed. A sensor system may also be included that detects if the support leg structure is in full contact with the ground. If the sensor system is included, the electronic interlock system prevents the work platform from being raised unless the sensor system indicates that the support leg structure is in full contact with the ground.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 1:
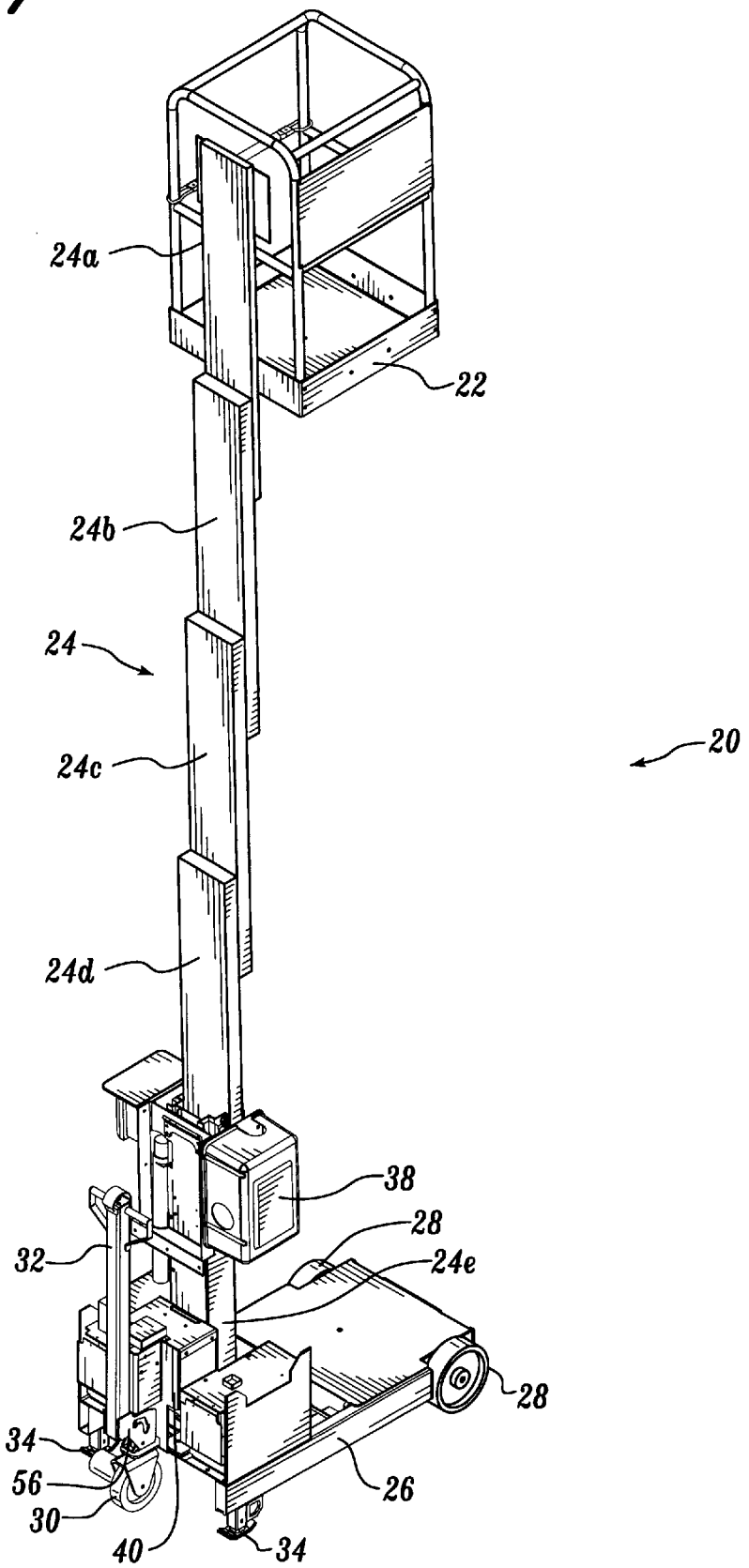
FIG. 1 is a side perspective view of a personnel lift embodying the present invention, with the aerial work platform in a raised position, the handle in an upright, locked position, and the support legs compressed against the ground.
Figure 2:
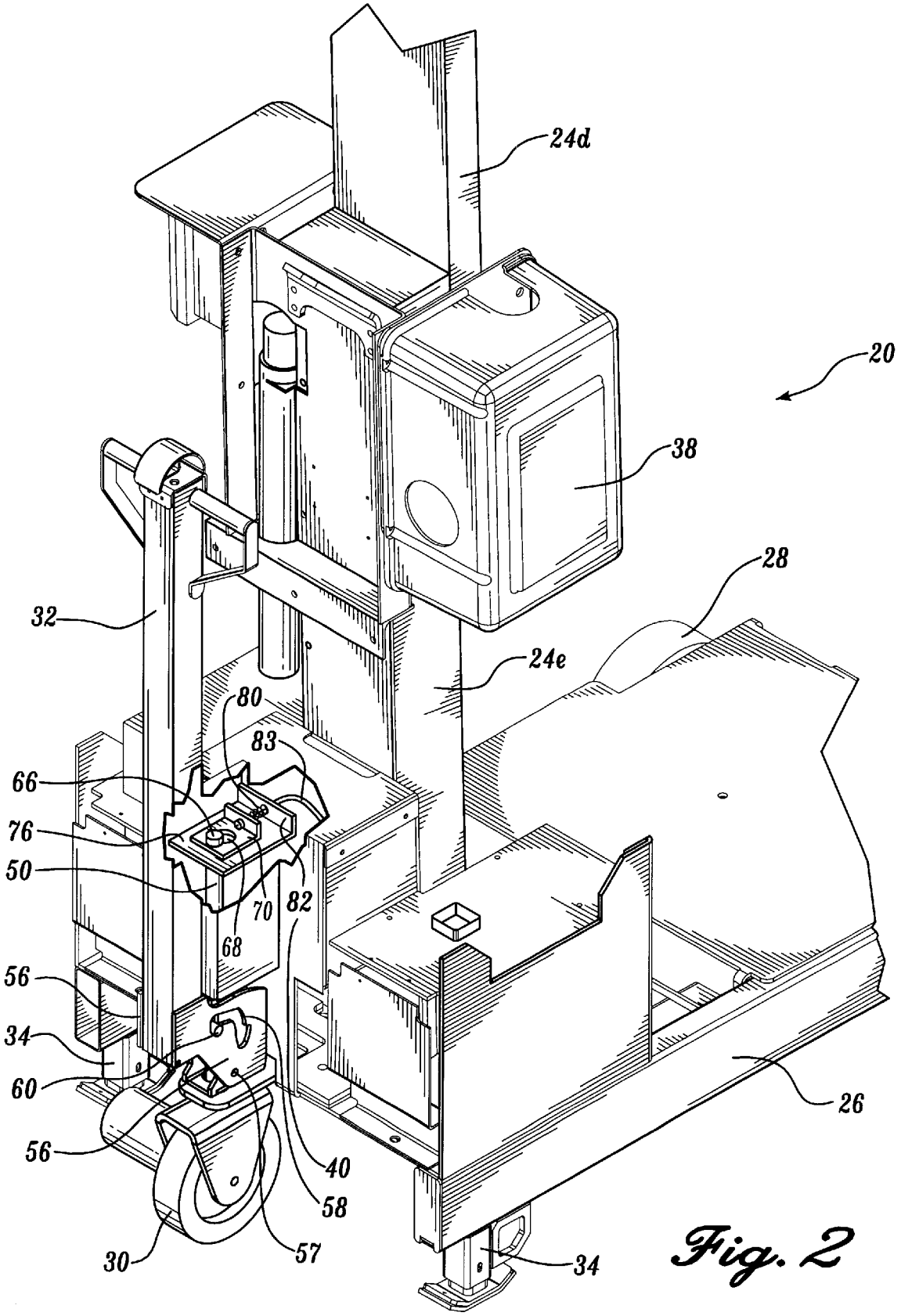
FIG. 2 is a side perspective view of the front portion of the personnel lift of FIG. 1, with parts broken away so that certain details of the invention can be seen.

Referring now to the drawing, in which like reference numerals represent like parts throughout the several views, FIG. 1 sets forth a personnel lift 20 embodying the present invention. The personnel lift 20 includes an aerial work platform 22 attached to an upper column 24*a* of a vertical lift assembly 24, in the drawings shown as a vertical tower of nested, telescoping columns 24*a–e*. The columns 24*a–e* are attached to a base 26 that includes front wheels 28. The rear end 20 of the base 26 includes a transport wheel 30 linked to a handle 32. Support legs 34 are positioned on opposite corners of the rear end of the base 26. A motor 38 located at the base of the vertical lift assembly 24 operates the vertical lift assembly 24 to lift the aerial work platform 22. A protective casing 40 is located at the rear side of the vertical lift assembly 24.

Figure 3:
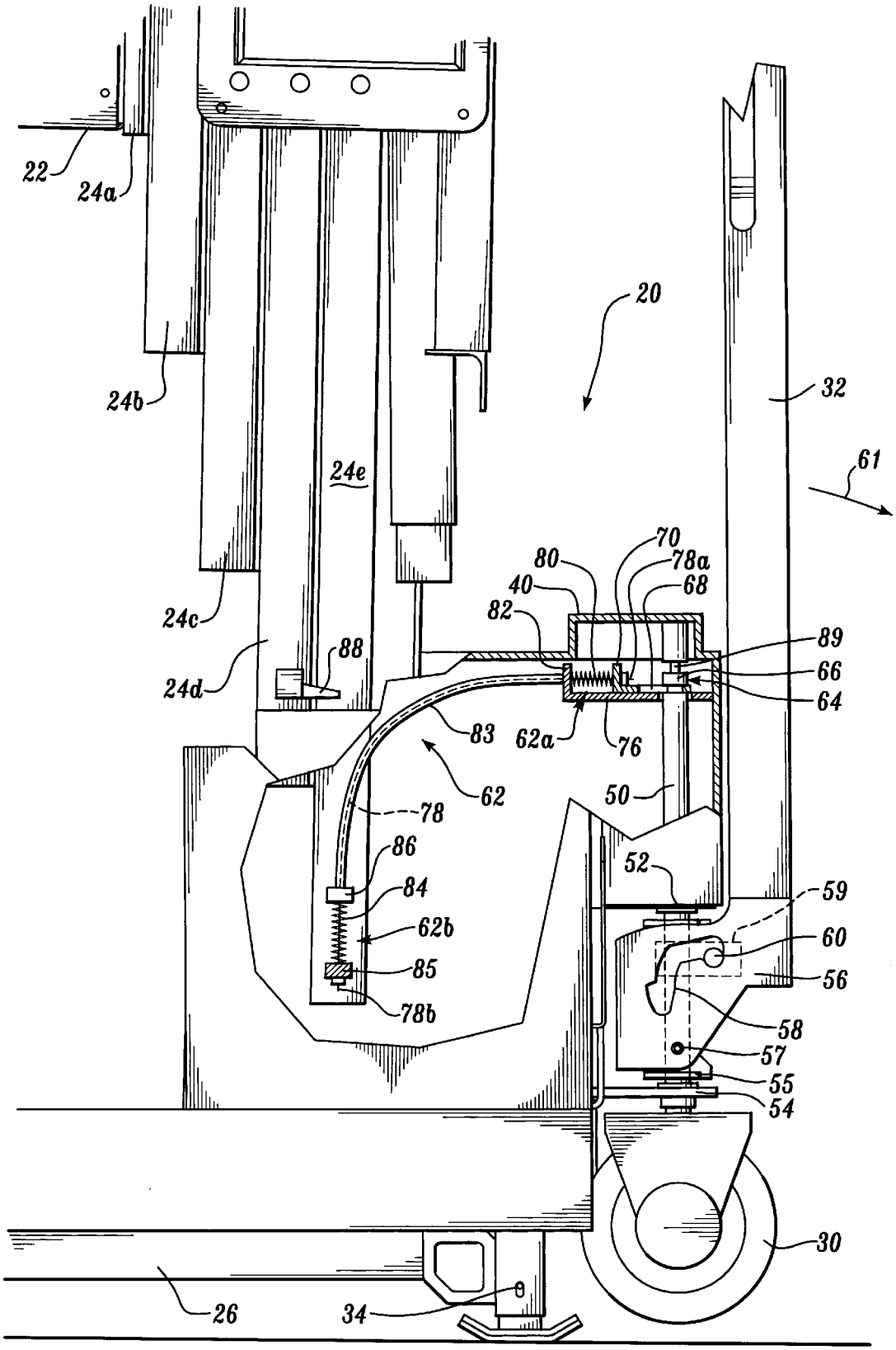
FIG. 3 is a side view of the personnel lift of FIG. 1, with the aerial work platform partially raised, the handle in an upright position, and the support legs contacting the ground and with parts broken away so that certain details of the invention can be seen.
Figure 4:
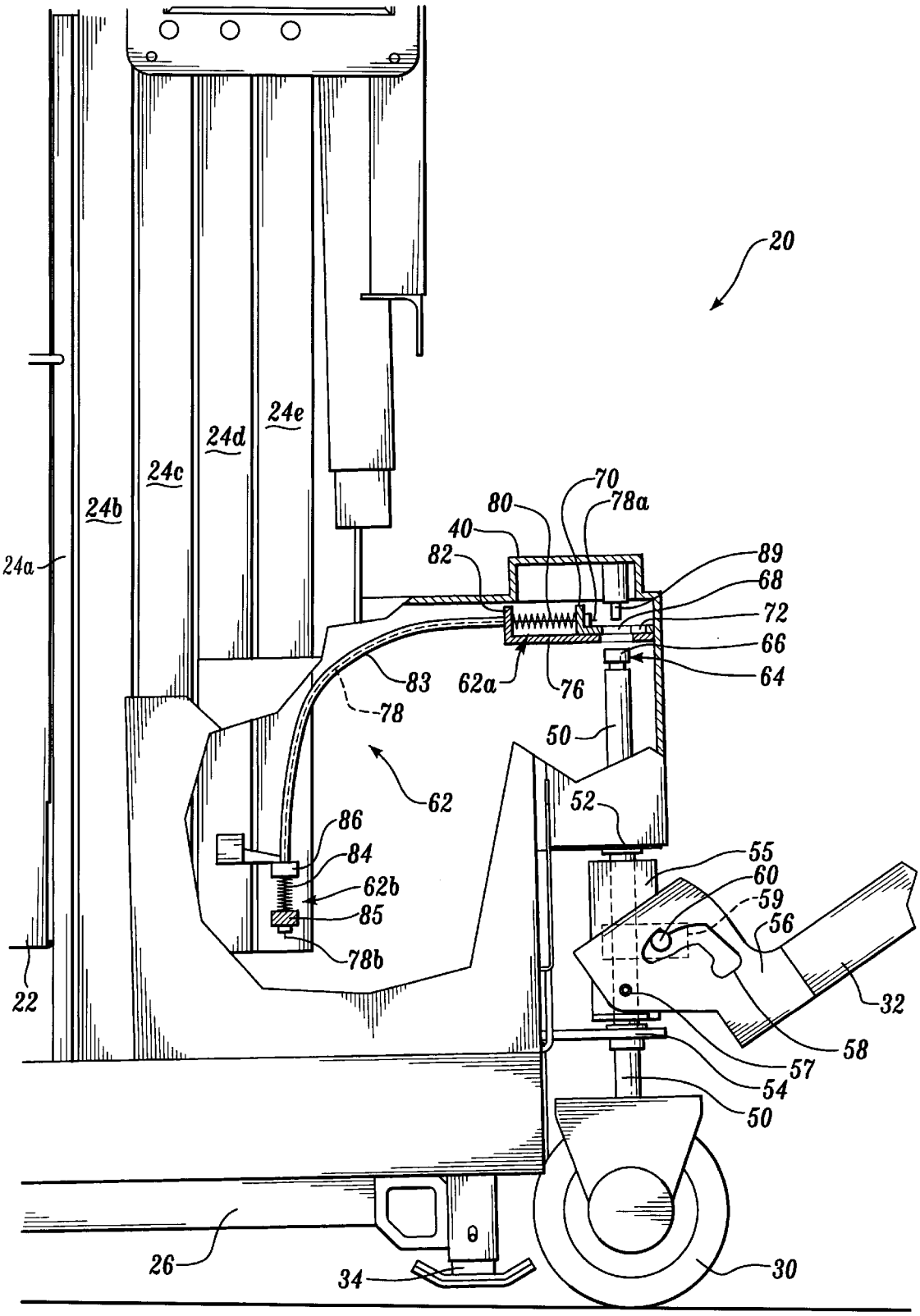
FIG. 4 is a side view of the personnel lift of FIG. 1, with the aerial work platform in a stowed position, the handle in a transport position and the support legs released from the ground with parts broken away so that certain details of the invention can be seen.

Briefly described, lowering the handle 32 to the transport position shown in FIG. 4 drops the transport wheel 30 to ground level, raising the support legs 34 off the ground. The personnel lift 20 may then be moved by pulling on the handle 32, causing the front wheels 28 and the transport wheel 30 to roll. Once a desired location is reached, the handle 32 is raised to the upright position shown in FIG. 1. Raising the handle 32 lifts the transport wheel 30 off the ground and lowers the support legs 34 into contact with the ground (FIG. 3). A worker can then enter the aerial work platform 22 and operate controls (not shown, but well known in the art) located on the aerial work platform 22 to energize the motor 38 and other elements of a lift system (not shown, but well known in the art) that lifts the aerial work platform 22. The lift system may be hydraulic, a continuous chain system, or any other desired mechanism that causes the nested columns 24*a–e* to slide relative to one another so that they move into an end-to-end configuration, as shown in FIG. 1. The structure and operation of a similar personnel lift is set forth in detail in U.S. Pat. No. 5,337,858.

The transport wheel 30 is attached to the lower end of a vertically oriented rod 50. As can best be seen in FIG. 4, the rod 50 is axially guided at upper and lower locations 52, 54 on the rear end of the base 26. A sleeve 55 extends between the upper and lower locations 52, 54 and receives the rod 50. The handle 32 includes a pair of brackets 56 at its lower end adapted to extend on opposite sides of the rod 50. The lower end of the brackets 56 are pivotally attached to a pin 57 that is fixed to the sleeve 55 on opposite sides of the rod 50. The brackets 56 each include dog-leg shaped cam slots 58 that extend outwardly and downwardly. The cam slots receive a cam follower 60. The cam follower 60 is a horizontally oriented rod attached to a block 59 (FIG. 3) affixed to the rod 50 for up and down movement with the rod 50.

The handle 32 is moved from the raised position of FIG. 1 to the transport position of FIG. 4 by pulling the handle forward and down in the direction of the arrow 61 in FIG. 3. Such movement causes the brackets 56 to rotate about the pin 57. As the brackets 56 rotate about the pin 57, the cam follower 60 follows the cam slots 58, forcing the rod 50 and the transport wheel 30 downward. Downward movement of the transport wheel 30 raises the support legs 34 above the ground, placing the weight of the rear end of the personnel lift 20 on the transport wheel 30 (FIG. 4). In the full down position (FIG. 4), the cam follower is latched by a detent. Conversely, when the handle 32 is rotated from the transport position of FIG. 4 to the raised position of FIG. 3, the cam follower 60 follows the cam slots 58 upward, forcing the rod 50 and the transport wheel 30 to move upward. As the transport wheel is raised, the support legs 34 are lowered into contact with the ground. In the full handle upright position (FIG. 3), the transport wheel 30 lies above the ground and the cam follower is latched by a second detent.

The personnel lift 20 includes a locking mechanism 62 (FIGS. 3 and 4) that maintains the handle 32 in the upright position when the aerial work platform 22 is raised. As is described in detail below, the locking mechanism 62 mechanically links the rod 50 to the vertical lift assembly 24 such that the rod and, thus, the handle may not be lowered from the upright position when the aerial work platform 22 is raised more than a few inches.

Figure 7:
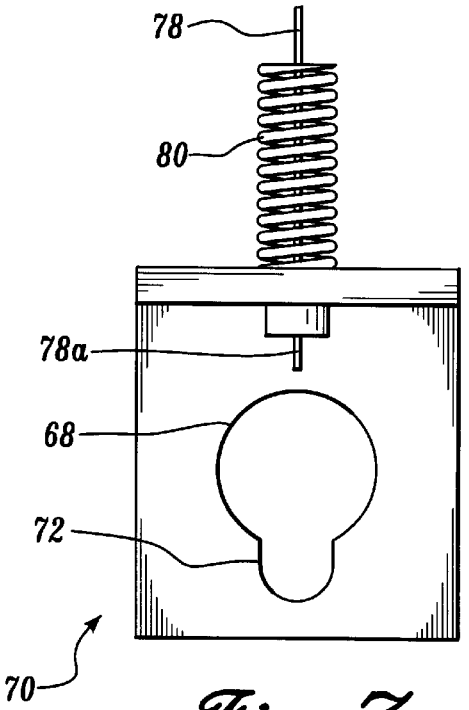
FIG. 7 is a top view of an L-bracket included in the locking mechanism of the personnel lift of FIG. 1.

A first portion 62*a* of the locking mechanism 62 is linked to the rod 50. This portion of the locking mechanism 62 is located within the protective casing 40 which surrounds the top of the rod 50. As can be seen in FIGS. 3 and 4, the top of the rod 50 includes a circumferential undercut that results in the formation of an integral pin 64 that extends axially from the top of the rod 50. The pin 64 includes an enlarged head 66 adapted to extend through an opening 68 in one leg of an L-bracket 70 (FIG. 7). The leg containing the opening is horizontally arrayed and the opening 68 has an old fashioned keyhole shape. More specifically, the opening has a large diameter region and a narrowed portion 72 which has a diameter smaller than the head 66, but larger than the diameter of the undercut region that defines the pin 64, the function of which will be described in detail below. The remainder of the opening 68 has a diameter larger than the head 66. The narrow portion protrudes outwardly from the remainder of the opening.

The L-bracket 70 is slidably mounted on a plate 76 located within the protective casing 63. One end 78*a* of a wire 78 of a control cable is attached to the back side of the other leg of the L-bracket 70, which is vertically retained, by a fastener, welding, or another conventional method. A first coil spring 80 surrounds the wire 78 and extends between the L-bracket 70 and a bracket 82 that is positioned at the rear of the plate 76. The wire 78 extends through the bracket 82 into a sleeve 83 of the control cable. The wire 78 is mounted in the sleeve such that the wire can freely slide back and forth. The end of the sleeve adjacent the end 78*a* of the cable is affixed to the bracket 82.

The sleeve 83 extends to the last column 24*e* of the vertical lift assembly 24. The other end 78*b* of the wire 78 extends out of the sleeve 83 and is attached in the manner described below. The attachment of the other end 78*b* of the wire 78 to the vertical lift assembly 24 forms the second portion 62*b* of the locking mechanism 62. The second end 78*b* of the wire 78 extends through a second coil spring 84. The spring constant of the second spring 84 is greater than the spring constant of the first spring 80. The lower end of the second spring 84 presses against a bracket 85. The bracket 85 is fixed to column 24E. An inverted cup 86 is fastened to the sleeve 83 of the control cable and presses against the top of the second spring 84. The other end 78*b* of the wire 78 is attached to the bracket 85. The function of this connection is described in detail below.

An arm 88 is attached to and extends transversely from the second to the last column 24*d* of the vertical lift assembly 24. The arm 88 is positioned to engage the top of the inverted cup 86 when the second to the last column 24*d* is nearest its lowest position relative to the last column 24*e*.

The function and operation of the locking mechanism 62 will now be described. When the vertical lift assembly 24 is in the down position shown in FIG. 4, the arm 88 presses on the top of the inverted cup 86. The pressure of the arm 88 on the inverted cup 86 compresses the second spring 84 between the inverted cup 86 and the bracket 85. The compression of the second spring 84 creates slack in the wire 78. The slack in the wire 78 permits the first spring 80 to decompress and extend (FIG. 4). The extension of the first spring 80 forces the L-bracket 70 to the right, as is shown in FIG. 4.

With the L-bracket 70 to the right as shown in FIG. 4, the pin 64 is aligned with the larger diameter portion of the opening 68 of the L-bracket 70. With the pin 64 and the opening 68 arranged in this manner, the handle 32 can be lowered to the transfer position of FIG. 4, causing the rod 50 and, thus, the transport wheel 30, to move downward to the transport position. As this downward movement occurs, the head 66 of the pin 64 moves through the larger diameter portion of the opening 68.

If the vertical lift assembly 24 is slightly raised while the handle is raised, the locking mechanism 62 is engaged and prevents the handle 32 from being lowered. The construction of the vertical lift assembly 24 is such that each of the columns 24*a–d* move slightly upward as part of the first motion in raising the aerial work platform 22. As this movement begins, the arm 88 moves away from the top of the inverted cup 86 and the second spring 84 decompresses. Because the spring constant of the second spring 84 is greater than the spring constant of the first spring 80, the decompression of the second spring 84 causes the wire 78 to be drawn through the cable-protecting sleeve 83 toward the second spring 84, compressing the first spring 80. The compression of the first spring 80 causes the L-bracket 70 to move to the left such as is shown in FIG. 3, aligning the head 66 on the pin 64 with the narrowed portion 72 of the opening 68. A user is precluded from lowering the handle 32 to the transport position of FIG. 3 when the L-bracket 70 is in this position because attempted movement of the handle downward causes the head 66 to contact the L-bracket 70 at the outer edges of the narrow portion 72 of the opening 68. In this manner, the rod 50 is prevented from moving downward and the handle 32 is locked in the raised position. When the vertical lift assembly 24 is lowered to the stowed position, the L-bracket 70 moves to the right (FIG. 3), aligning the head 66 with the broader portion of the opening 68. As a result, the handle 32 is free to move to the transport position.

A depressible switch 89, which forms part of an electrical interlock, is located inside the top of the protective casing 40. The depressible switch 89 is positioned such that it is closed by the head 66 when the handle 32 is in the raised position (FIG. 3), and is open when the handle is in the transport position (FIG. 4). The function of the depressible switch 89 will be discussed in detail below.

Figure 5:
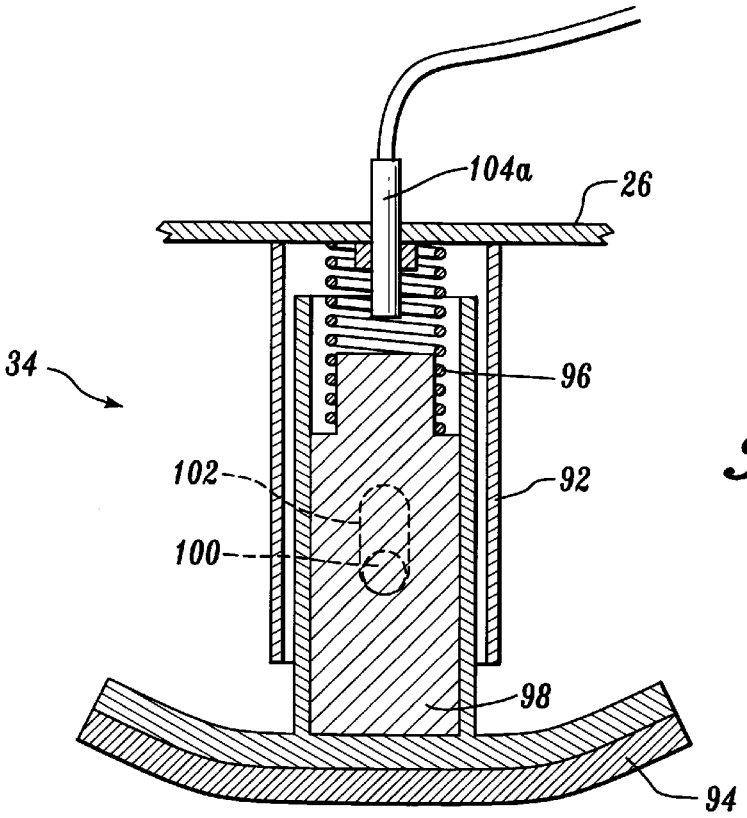
FIG. 5 is a detailed vertical section view of one of the support legs of the personnel lift of FIG. 1.

Referring to FIG. 5, a detailed vertical sectional view of one of the support legs 34 is shown. The support leg 34 is vertically slide mounted in a rigid guide 92 that is fixed to the base 26. The support leg 34 has a foot pad 94 mounted on its lower end. A compression spring 96 is mounted within the rigid guide 92 and engages an insert 98 plugged into the support leg 34. The compression spring 96 biases the support leg 34 downwardly relative to the base 26. The range of sliding movement of the support leg 34 is controlled by a cross-pin 100 extending through the support leg and insert 98. The ends of the cross-pin 100 ride in a pair of slots 102 in the support leg. A depressible switch 104*a* is mounted on the base 26 for engaging the upper end of the insert 98 when the support leg 34 is retracted responsive to taking part of the weight of the personnel lift 20. A similar depressible switch 104*b* (FIG. 6 only) is mounted in the second support leg 34. The depressible switches are closed when the switches contact their respective inserts 98 and open when they are out of contact with their respective inserts.

The switches 104*a*, 104*b* in the support legs 34 and the depressible switch 89 in the locking mechanism 62 are arranged in the power circuit for the motor 38 such that when any of the switches are open, the motor is inoperative. Thus, unless both rear support legs 34 are loaded by the weight of the personnel lift 20, and the handle 32 is in the raised position, the vertical lift assembly 24 cannot be raised.

Figure 6:
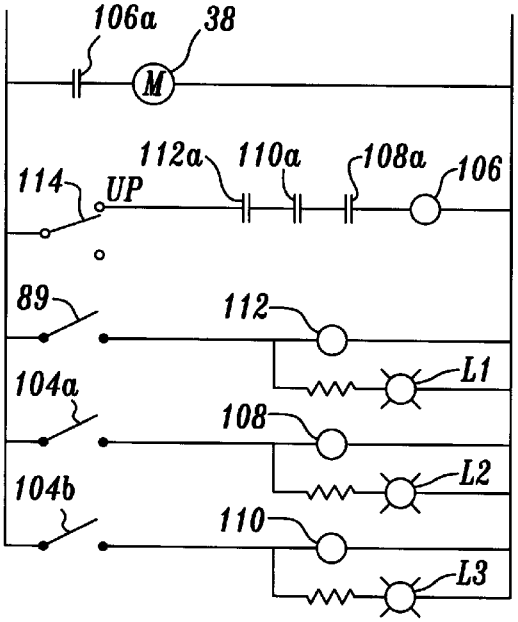
FIG. 6 is an electrical schematic of the interlock system of the vertical lift assembly of the personnel lift of FIG. 1.

A simple schematic for the control circuit for the motor 38 is shown in FIG. 6. The motor 38 is connected in series with a set of normally open motor contacts 106*a*. An up switch 114 is connected in series with three sets of normally open contacts 108*a*, 110*a* and 112*a* and the coil 106 that operates the set of motor contacts 106*a*. The switches 104*a* and 104*b* operated by the support legs are each connected in series with a coil 108 and 110 that operate a set of the contacts 110*a* and 112*a* connected in series with the up switch 114. The switch 89 operated by the rod 50 is connected in series with a coil 112 that operates the other set of contacts connected in series with the up switch 114. Indicator circuits formed by indicator lights L1, L2 and L3 connected in series with current limiting resistors are connected in parallel with each of the relay coils 108, 110 and 112.

Once the base 26 is set, the switches 104*a*, 104*b*, will be closed unless one of the support legs 34 is not properly in ground engagement. When the support leg operated switches 104*a*, 104*b* are closed two of the indicator lights L2–L3, which are located on the control panel at the front of a control box (not shown), are lit. If the indicator lights are not lit, the operator is advised which support leg 34 is not taking its share of the weight of the lift. More importantly, the related relay coil 108 or 110 will not be energized, whereby the related set of contacts 108*a* or 110*a* will not be closed, preventing power from being applied to the motor 38.

As noted above, the rod operated switch 89 will open unless the handle is in the raised position. When the rod operated switch 89 is open, the other indicator light, L1, which is also located on the control panel of the control box, is not lit. Again, more importantly, the related relay coil 112 will not be energized, whereby the related set of contacts 112*a* will not be closed.

When all lights L1, L2, L3 on the control panel are lit, the aerial work platform 22 may be raised by the controls on the aerial work platform because all of the relay coils 108, 110 and 112 will be energized.

The motor 38 is started to raise the aerial work platform 22 responsive to the closing of a switch 106*a* operated by a relay 106. The relay 106 is energized when the normally open sets of contacts 108*a*, 110*a*, and 112*a* operated by relay coils 108, 110, 112 are closed and the up switch 114 is closed, i.e., moved to the UP position by a worker in the aerial work platform 22. As described above, relay coils 108, 110 are only energized when the support leg switches 104*a*, 104*b* are closed as a result of the respective support leg engaging the ground. Relay coil 112 is only energized when the rod operated switch 89 is closed, indicating that the handle 32 is in the raised position.

The personnel lift 20 of the present invention provides many benefits not offered by prior art devices. The personnel lift 20 provides a transportable base 26 that is easily manipulated by a user by operating the handle 32. Lowering the handle 32 to the transport position of FIG. 3 lowers the transport wheel 30 to ground level, raising the support legs 34 above the ground. In this position, the handle 32 can be used to pull the personnel lift 20 to a desired location. Because the transport wheel 30 is mounted on a rod 50 that is rotatable about a vertical axis, the wheel 30 follows the movement of the handle 32 permitting easy steering and positioning of the personnel lift 20.

Raising the handle 32 lifts the transport wheel 30 off the ground allowing support legs 34 to press against the ground and compress their respective springs. The personnel lift 20 includes two systems for enhancing the safety of its operation. An electric interlock system is utilized to prevent the vertical lift assembly 24 from being used when the support legs 34 are not compressed and the handle 32 is not in the raised position. When the handle 32 is in the raised position and each of the support legs 34 are in full contact with the ground, the three switches 89, 104*a*, 104*b*, are closed, allowing the aerial work platform 22 to be elevated. If any of the switches 104*a*, 104*b*, 89 are not closed, the aerial work platform may not be elevated. The locking mechanism 62 prevents the user from lowering the transport wheel 30 and moving the personnel lift 20 when the aerial work platform 22 is raised. Once the locking mechanism 62 is engaged, the handle 32 cannot be lowered far enough to make the transport wheel 30 engage the ground and release the support legs 34 from their stabilized position.

While the preferred embodiment of the invention has been illustrated and described, it will be appreciated that various changes can be made therein without departing from the spirit and scope of the invention as defined in the appended claims.

The embodiments of the invention in which an exclusive property or privilege is claimed are defined as follows:

1. A personnel lift comprising:

a base;

a vertical lift assembly mounted on the base, the vertical lift assembly comprising a vertical tower of extended columns;

a work platform attached to the vertical lift assembly, the vertical lift assembly operative to lift the work platform;

a vertically movable transport wheel mounted to the base;

a support leg structure mounted on the base;

a handle operatively connected to the transport wheel and the base such that movement of the handle up and down causes a corresponding movement up and down of the transport wheel, the handle being movable between a first position in which the weight of the rear end of the base is placed on the transport wheel and the support leg structure is above the ground and a second position in which the transport wheel is above the ground and the weight of the rear end of the base is placed on the support leg structure; and a locking mechanism operatively connected between the vertical tower of extended columns and the handle operative to prevent movement of the handle to the first position when the vertical lift assembly is in a raised position.

2. The personnel lift of claim 1, wherein the vertical tower of extended columns comprises a first column which initiates movement of the work platform upward, and wherein the locking mechanism is operatively connected to the first column.

3. The personnel lift of claim 2, wherein the locking mechanism prevents movement of the handle to the first position when the first column has been raised only a few inches.

4. The personnel lift of claim 3, further comprising:

a motor for operating the vehicle lift assembly; and a motor control circuit for controlling the application of power to the motor, the motor control circuit including a switch that prevents the motor control circuit from applying power to the motor unless the support leg structure is in contact with the ground.

5. The personnel lift of claim 4, wherein the motor control circuit further comprises an additional switch that prevents the motor control circuit from applying power to the motor unless the handle is in the second position.

6. A personnel lift comprising:

a base;

a vertical lift assembly mounted on the base;

a work platform attached to the vertical lift assembly, the vertical lift assembly operative to lift the work platform;

a vertically movable transport wheel mounted to the base;

a support leg structure mounted on the base;

a handle operatively connected to the transport wheel and the base such that movement of the handle up and down causes a corresponding movement up and down of the transport wheel, the handle being movable between a first position in which the weight of the rear end of the base is placed on the transport wheel and the support leg structure is above the ground and a second position in which the transport wheel is above the ground and the weight of the rear end of the base is placed on the support leg structure;

a vertically oriented rod extending upwardly from the transport wheel and movable up and down with the transport wheel in response to the positioning of the handle between the first position and the second position; and a locking mechanism operatively connected between the vertical lift assembly and the handle operative to prevent movement of the handle to the first position when the vertical lift assembly is in a raised position, the locking mechanism being operatively connected to the rod when the work platform is in a raised position such that the locking mechanism prevents movement of the rod up and down and thereby prevents movement of the handle to the first position.

7. The personnel lift of claim 6, wherein the rod comprises a smaller diameter portion and a larger diameter portion axially displaced above the smaller diameter portion, and the locking mechanism comprises: (i) a plate having a groove whose width is slightly larger than the smaller diameter portion of the rod and smaller than the larger diameter portion of the rod; and (ii) a coupling mechanism for coupling the vertical lift assembly to the plate such that when the work platform is moved upward, the groove engages the smaller diameter portion of the groove.

8. The personnel lift of claim 7, wherein the vertical lift assembly comprises a vertical tower of extended columns, and wherein the locking mechanism is connected to the vertical tower of extended columns.

9. The personnel lift of claim 8, wherein the vertical tower of extended columns comprises a first column which initiates movement of the work platform upward, and wherein the locking mechanism is operatively connected to the first column.

10. The personnel lift of claim 9, wherein the locking mechanism prevents movement of the handle to the first position when the first column has been raised only a few inches.

11. A personnel lift comprising:

a base;

a vertical lift assembly mounted on the base;

a motor for operating the vertical lift assembly;

a work platform attached to the vertical lift assembly for receiving a worker, the vertical lift assembly operative to lift the work platform;

a vertically movable transport wheel mounted to the base;

a support leg structure mounted on the base;

a handle operatively connected to the transport wheel and the base such that movement of the handle up and down causes a corresponding movement up and down of the transport wheel, the handle being movable between a first position in which the weight of the rear end of the base is placed on the transport wheel and the support leg structure is above the ground and a second position in which the transport wheel is above the ground and the weight of the front end of the base is placed on the support leg structure; and a motor control circuit for controlling the application of power to the motor, the motor control circuit including a switch that prevents the motor control circuit from applying power to the motor when the handle is in the second position.

12. The personnel lift of claim 11, wherein the motor control circuit comprises an additional switch that prevents said motor control circuit from applying power to the motor unless the support leg structure is in contact with the ground.

13. A personnel lift comprising:

a base;

a vertical lift assembly mounted on the base;

a work platform attached to the vertical lift assembly, the vertical lift assembly operative to lift the work platform;

a vertically movable transport wheel mounted to the base;

a support leg structure mounted on the base;

a handle operatively connected to the transport wheel and the base such that movement of the handle up and down causes a corresponding movement up and down of the transport wheel, the handle being movable between a first position in which the weight of the rear end of the base is placed on the transport wheel and the support leg structure is above the ground and a second position in which the transport wheel is above the ground and the weight of the rear end of the base is placed on the support leg structure;

a locking mechanism operatively connected between the vertical lift assembly and the handle operative to prevent movement of the handle to the first position when the vertical lift assembly is in a raised position;

a motor for operating the vehicle lift assembly; and a motor control circuit for controlling the application of power to the motor, the motor control circuit including a switch that prevents the motor control circuit from applying power to the motor unless the handle is in the second position.

* * * * *